US006030010A

United States Patent [19]

Graeff

[11] Patent Number: 6,030,010

[45] Date of Patent: Feb. 29, 2000

[54] APPARATUS FOR SUPPORTING A TRASH BAG

[76] Inventor: William F. Graeff, 7705 Densmore Ave., Van Nuys, Calif. 91406

[21] Appl. No.: 09/173,724

[22] Filed: Oct. 16, 1998

[51] Int. Cl.[7] ..... A47F 13/06

[52] U.S. Cl. ..... 294/1.1; 294/55; 248/99

[58] Field of Search ..... 294/1.1, 55, 93, 294/1.3, 1.4; 248/99, 101, 95, 97; 141/390, 316; 383/33, 12; 15/257.7, 257.1

[56] References Cited

U.S. PATENT DOCUMENTS

| | | | |
|---|---|---|---|
| 46,498 | 2/1865 | Ramsey . | |
| 69,989 | 10/1867 | Harding | 248/99 |
| 323,141 | 7/1885 | Hatz . | |
| 1,228,333 | 5/1917 | McBurney . | |
| 1,468,709 | 9/1923 | Grandeur et al. | 294/1.1 |
| 2,401,969 | 6/1946 | Schlank | 248/101 X |
| 2,505,289 | 4/1950 | Haslett | 294/93 |
| 2,942,823 | 6/1960 | Chapman | 248/97 |
| 3,711,141 | 1/1973 | Soergel | 294/55 |
| 4,006,928 | 2/1977 | Beugin . | |
| 4,023,842 | 5/1977 | Harvey . | |
| 4,479,344 | 10/1984 | Edwards . | |
| 4,615,743 | 10/1986 | Bylenga . | |
| 4,832,292 | 5/1989 | Beckham . | |
| 4,962,956 | 10/1990 | Scripter . | |
| 5,009,378 | 4/1991 | Linsmeyer et al. | 248/99 |
| 5,011,103 | 4/1991 | Hayes et al. . | |
| 5,050,920 | 9/1991 | Potticary . | |
| 5,183,339 | 2/1993 | Williams | 383/33 |
| 5,409,279 | 4/1995 | Magee | 294/1.3 |
| 5,413,394 | 5/1995 | Mitchell . | |
| 5,615,853 | 4/1997 | Hearst . | |

*Primary Examiner*—Ramon O. Ramirez
*Assistant Examiner*—Stephen S. Wentsler
*Attorney, Agent, or Firm*—Blank Rome Comisky & McCauley LLP

[57] ABSTRACT

Apparatus for supporting a trash bag for use in collecting leaves, cuttings and other lawn debris comprises a frame assembly formed of a metal rod bent into a substantially rectangular shape with a pair of generally S-shaped terminations. A pair of feet formed of metal strips welded to the rod support the frame in an upright position for ease in filling the trash bag with debris. The rod is adapted to be flexed into engagement with the bag to retain it securely in position by means of a handle which holds the frame in an outwardly flexed condition against the bag.

15 Claims, 1 Drawing Sheet

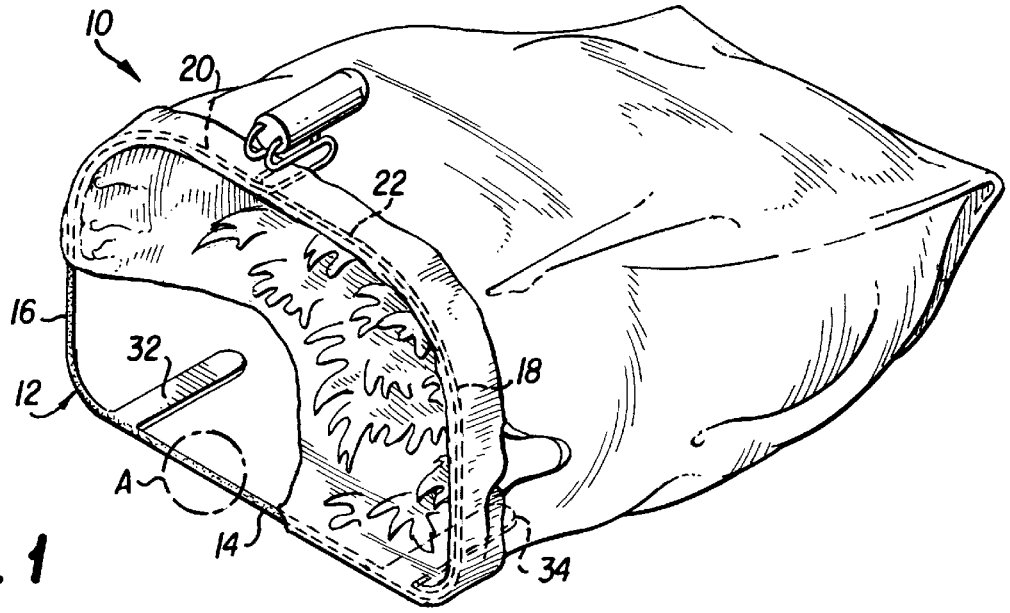
FIG. 1
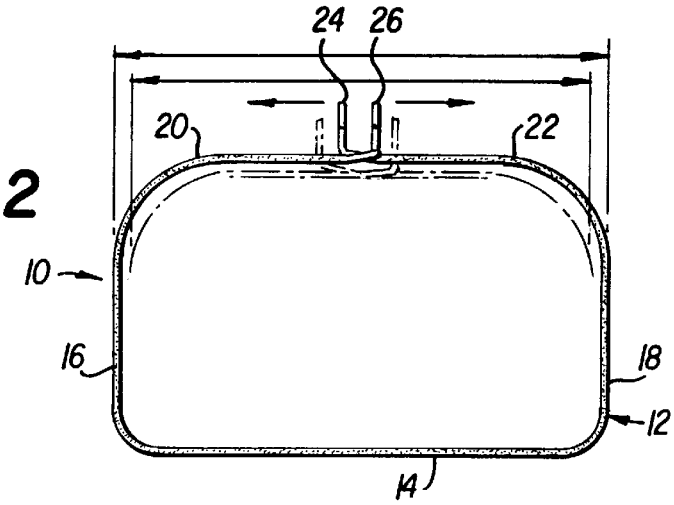
FIG. 2
FIG. 3
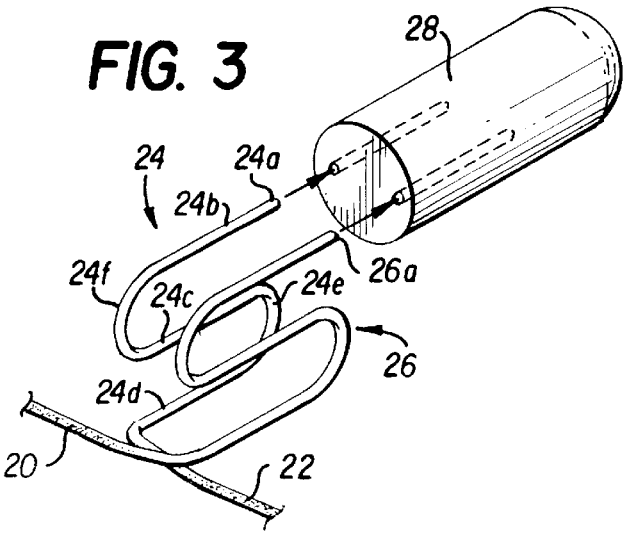
FIG. 4
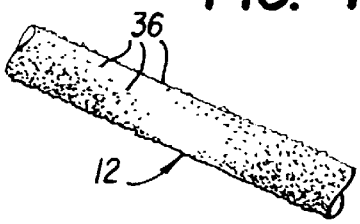

APPARATUS FOR SUPPORTING A TRASH BAG

FIELD OF THE INVENTION

The present invention relates to apparatus for supporting a trash bag and more particularly to a flexible frame for securely holding open a plastic lawn bag for collecting leaves, grass clippings and other lawn debris.

BACKGROUND OF THE INVENTION

Conventional lawn bags are frequently difficult for one person to use efficiently. Typical plastic lawn bags are pliable and limp. As a result, someone wishing to deposit leaves or grass clippings into a bag must hold the bag open while simultaneously filling the bag with leaves, clippings and lawn debris. Devices are known which hold a bag open for this purpose. One of the problems associated with existing frames is that they are formed with complex, difficult-to-manufacture parts or with special fasteners in order to grip the slippery surface of a lawn bag. Many such frames have the additional drawback of requiring assembly of multiple parts.

Plastic trash bag holders for collecting lawn debris are well known in the art. Examples of such bag holders are disclosed in U.S. Pat. Nos. 4,479,344; 4,615,743; 4,023,842; 4,006,928; and 5,011,103. The bag holders disclosed in those patents suffer from many of the deficiencies described above. It would be desirable, therefore, to provide a free-standing frame requiring no assembly about which a plastic lawn bag can be easily secured, so as to minimize the time required to both assemble the frame and secure the bag to the frame.

SUMMARY OF THE INVENTION

In view of the foregoing limitations of the prior art devices, as well as other disadvantages not specifically mentioned above, it should be apparent that there exists a need in the art for a lawn bag frame which securely holds a lawn bag open without the need for complex parts or fasteners. It is therefore a primary objective of this invention to fulfill that need by providing a unitary lawn bag frame that is easy to assemble and operate.

It is also an objective of the present invention to provide a lawn bag supporting device which does not require a plurality of parts that must be assembled and which may be easily misplaced.

It is a further objective of the invention to provide a lawn bag supporting device that securely grips the slippery surfaces of a plastic lawn bag so as to reliably hold it in place for use.

Yet another object of the present invention is to provide a lawn bag supporting device that can be easily and inexpensively manufactured.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a perspective view showing the operation of the present invention in use for collecting lawn debris;

FIG. 2 is a front elevation view of the present invention illustrating the manner in which the frame is flexed in order to engage a bag;

FIG. 3 is an enlarged fragmentary exploded view showing the manner of engaging the handle with the frame; and FIG. 4 is an enlarged fragmentary detail illustrating the granular surface of the frame, identified as detail A in FIG. 1.

DETAILED DESCRIPTION OF THE INVENTION

Reference will now be made in detail to the preferred embodiment of the invention illustrated in the accompanying drawings, wherein like parts are designated by like numerals throughout. FIGS. 1–4 illustrate an exemplary embodiment of the lawn bag frame of the invention which is designated generally by reference numeral 10.

Referring now in detail to FIGS. 1 and 2, the frame 10 comprises a rod 12, preferably made from ¼ inch diameter steel rod, formed into a generally rectangular shape with rounded comers. The rectangular shape has a lower portion 14, two upstanding side portions 16, 18 and two upper portions 20, 22. The rod 12 terminates at the terminal ends 24*f*, 26*f* of the two upper edges 20, 22. The two upper portions 20, 22 are bent at their inner ends to form two parallel, generally S-shaped terminations 24, 26 (FIG. 3). The upper portions 20, 22 cross one another as best seen in FIG. 3 so that when the S-shaped terminations 24, 26 are urged together or toward one another, the frame 10 enlarges from the dashed line position to the solid line position with a greater perimetrical dimension as shown in FIG. 2.

When urged together to the positions shown in FIG. 3, the S-shaped terminations 24, 26 are positioned to be engaged with a handle 28. In the preferred embodiment, the handle 28 is formed with two bores 30*a*, 30*b* into which the free ends 24*a*, 26*a* of the S-shaped terminations 24, 26 are inserted to secure the terminations 24, 26 in fixed relation to one another.

Referring now to FIG. 3, there is shown an exploded view of the S-shaped terminations 24, 26 and handle 28. The handle 28 may be of any suitable size and shape to fit into the hand of a user. The S-shaped terminations 24, 26 are identical, therefore, only one is described in detail. The S-shaped termination 24 is formed from three parallel rod sections 24*b*, 24*c*, 24*d* interconnected by two semi-circular rod sections 24*e*, 24*f*.

Two stabilizing feet 32, 34 (FIG. 1) are rigidly affixed to the lower portion 14 or integrally formed therewith by the appropriate bending of the lower portion 14 to form feet, such that when the lower portion 14 and feet 32, 34 are rested on a horizontal surface, the rectangular opening of the frame 10 stands upright or substantially perpendicular to the horizontal surface. Feet 32, 34 are preferably formed by flat metal strips welded to the lower portion 14 of said rod 12 at spaced locations.

In order to engage the bag B with the frame 10, the open end of bag B is inserted through the opening of the frame 10 and then folded back about the entire perimetrical extent of rod 12. Alternatively, the frame 10 and the lower portions of the terminations 24, 26 may be inserted into the opening of bag B. The S-shaped terminations 24, 26 are then urged together to enlarge the frame 10 outwardly against the inside surface of the opening of bag B. When the bag B is fully engaged and held tautly by the frame 10, the S-shaped terminations are inserted into the bores 30*a*, 30*b* formed in the handle 28 to securely hold the bag B open.

The lower portion 14, two side portions 16, 18, and upper portions 20, 22 are each coated with a granular substance 36 (FIG. 4). The granular substance 36 may be composed of any coarse-grained material, such as sand or the like. When the frame 10 is flexed to engage the bag B, the granular substance 36 creates friction with the slippery surface of the bag B, preventing the bag B from slipping off of the frame 10 as it is filled with lawn debris.

Although the rod 12 is preferably made of metal materials, it is contemplated within the scope of the invention that the rod 12 can be made of polymeric or other synthetic materials, so long as the material has sufficient strength to maintain the form of the frame 10 under the ordinary stresses of usage, and also possesses an appropriate degree of resilience.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim is:

1. An apparatus for supporting a trash bag, comprising:

a one-piece rod formed into a generally rectangular shaped frame with a generally rectangular opening, said rod having a lower portion, two side portions and two upper portions, said upper portions of said rod crossing one another and being bent to form two generally S-shaped terminations each with a free end portion, said terminations being flexible toward one another to enlarge the size of said opening and away from one another to reduce the size of said opening; and a handle having means for receiving the free end portions of said terminations to hold said terminations in a fixed relation to one another, whereby said rod is engagable with said trash bag to hold the same in an open condition.

2. The apparatus of claim 1, including two feet attached to said lower portion for supporting said frame upright with respect to a surface on which said apparatus is rested.

3. The apparatus of claim 2, wherein said two feet comprise flat metal strips affixed in spaced relation to the lower portion of said rod.

4. The apparatus of claim 1, wherein at least portions of said rod are coated with a granular substance.

5. The apparatus of claim 1, wherein said receiving means in said handle comprises two parallel bores in said handle.

6. The apparatus of claim 1, wherein each S-shaped termination is formed by three parallel rod sections connected by two substantially semicircular rod sections.

7. The apparatus of claim 1, wherein said rod is formed of ¼ inch diameter steel rod.

8. The apparatus of claim 1, wherein said rod is formed of plastic.

9. The apparatus of claim 2, wherein said rod is formed of ¼ inch diameter steel rod and said feet comprise flat metal strips welded to said lower portion.

10. An apparatus for supporting a trash bag, comprising:

a one-piece steel rod formed by bending the rod into a generally rectangular shaped frame with a generally rectangular opening, said rod having a lower portion, two side portions and two upper portions, said upper portions of said rod crossing one another and being bent to form two terminations each with a free end portion, said terminations being flexible toward one another to enlarge the size of said opening and away from one another to reduce the size of said opening;

a handle having a pair of bores for receiving the free end portions of said terminations to hold said terminations in a fixed relation to one another, whereby said rod is engagable with said trash bag to hold the same in an open condition; and two feet attached to said lower portion for supporting said frame upright with respect to a surface on which said apparatus is rested.

11. The apparatus of claims 10, wherein at least portions of said rod are coated with a granular substance.

12. The apparatus of claim 10, wherein said feet comprise flat metal strips affixed in spaced relation to the lower portion of said rod.

13. The apparatus of claim 10, wherein said terminations each comprise an S-shaped portion formed by three parallel rod sections connected by two substantially semicircular rod sections.

14. The apparatus of claim 10, wherein said rod is formed of ¼ inch diameter steel rod.

15. The apparatus of claim 10, wherein said rod is formed of plastic.

* * * * *